US007753357B2

(12) United States Patent
Allen, Jr. et al.

(10) Patent No.: US 7,753,357 B2
(45) Date of Patent: Jul. 13, 2010

(54) STACKING APPARATUS HAVING TILTABLE MAIN CONVEYOR AND VARIABLE LENGTH TRANSFER CONVEYOR

(75) Inventors: Clarence Allen, Jr., Mt. Crawford, VA (US); Michael Lippy, Herndon, VA (US)

(73) Assignee: A.G. Stacker Inc., Weyers Cave, VA (US)

( * ) Notice: Subject to any disclaimer, the term of this patent is extended or adjusted under 35 U.S.C. 154(b) by 62 days.

(21) Appl. No.: 12/147,839

(22) Filed: Jun. 27, 2008

(65) Prior Publication Data

US 2009/0001653 A1 Jan. 1, 2009

Related U.S. Application Data

(60) Provisional application No. 60/947,077, filed on Jun. 29, 2007.

(51) Int. Cl.
*B65H 29/68* (2006.01)

(52) U.S. Cl. ..... 271/69; 271/198; 271/200

(58) Field of Classification Search ..... 271/69, 271/198, 200; 198/592, 594, 812
See application file for complete search history.

(56) References Cited

U.S. PATENT DOCUMENTS 2,785,787 A * 3/1957 Leavens, Jr. ..... 198/803.9
2,863,663 A * 12/1958 Richards ..... 271/69
2,904,334 A * 9/1959 Cundall et al. ..... 271/65
3,938,674 A * 2/1976 Kroeze et al. ..... 414/790.8
4,585,227 A * 4/1986 Muller ..... 271/270
5,201,397 A * 4/1993 Isaacs ..... 198/395
5,415,389 A * 5/1995 Adami ..... 271/203
6,945,531 B2 * 9/2005 Perobelli et al. ..... 271/270
7,316,394 B2 * 1/2008 Zeltner et al. ..... 271/306

* cited by examiner

*Primary Examiner*—David H Bollinger
(74) *Attorney, Agent, or Firm*—Muncy, Geissler, Olds & Lowe, PLLC

(57) ABSTRACT

A sheet stacking apparatus includes a conveyor support, a main conveyor connected to the conveyor support and having a discharge end movable between a lowered position and a raised position, a transfer conveyor having a intake end roller support holding the intake end roller in a fixed relationship with respect to the conveyor support and a discharge end roller connected to a main conveyor intake end roller, at least one idler roller, and at least one belt supported by the transfer conveyor intake end roller and the transfer conveyor discharge end roller and passing over the at least one idler roller, the main conveyor discharge end being movable between a lowered position and a raised position, and wherein the transfer conveyor discharge end roller is shifted away from the transfer conveyor intake end roller by the main conveyor discharge end moving from the lowered position to the raised position.

19 Claims, 7 Drawing Sheets

STACKING APPARATUS HAVING TILTABLE MAIN CONVEYOR AND VARIABLE LENGTH TRANSFER CONVEYOR

CROSS-REFERENCE TO RELATED APPLICATIONS

The present application claims the benefit of U.S. Provisional Patent Application No. 60/947,077, filed Jun. 29, 2007, the entire contents of which are hereby incorporated by reference.

FIELD OF THE INVENTION

The present invention is directed to a stacking apparatus having a tiltable main conveyor and a variable length transfer conveyor and to a method of moving sheets of material along the transfer conveyor and the main conveyor, and, more specifically, toward a stacking apparatus having a main conveyor with an intake end that moves laterally relative to a portion of a transfer conveyor as the main conveyor tilts and toward a method of moving sheets of material along the transfer conveyor and the main conveyor.

BACKGROUND OF THE INVENTION

Devices for stacking generally planar articles of material, such as sheets of corrugated material, are well known. One example of a commercially available device is the AGS2000 Rotary Die Cut Stacker made by the assignee of the present invention, A.G. Machine, Inc., Weyers Cave, Va. Further examples of such devices are disclosed in U.S. Pat. Nos. 3,321,202 to Geo. M. Martin and 3,419,266 to Geo. M. Martin, each of which is expressly incorporated herein by reference in its entirety.

FIGS. 1-3 illustrate a conventional apparatus for stacking sheets. The stacking machine 100 generally comprises a layboy section 102 which receives corrugated blanks, such as those produced by a rotary die cut machine (die 103 of which is illustrated in FIG. 2), and discharges the corrugated blanks onto a transfer conveyor 104. The transfer conveyor 104 receives the blanks and transports them to a main conveyor 106. The main conveyor 106 has an intake end 108 and a discharge end 110, while the transfer conveyor has an intake end 112 and a discharge end 114. At main conveyor intake end 108, the main conveyor 106 is mounted to a base 116 at a pivot point 118 so that the main conveyor 106 may be pivoted to raise its discharge end 110. At the discharge end 110 of main conveyor 106, an accumulator section 120 receives discharged blanks.

In operation, the main conveyor 106 is pivoted about the pivot point 118 to lower the discharge end 110 of the main conveyor 106 to an initial or lowered position, illustrated in FIG. 2. Sheets are fed onto the main conveyor 106 at its intake end 108, transported along the conveyor to its discharge end 110, and discharged from the conveyor toward a backstop 122 in accumulator section 120. The stopped sheets settle down, typically onto a discharge conveyor 132, to form a stack of sheets.

As additional sheets are placed on the stack, the main conveyor 106 is pivoted to raise the discharge end 110 thereof vertically so that the discharged sheets are discharged above the top of the growing stack. If pivot point 118 were laterally fixed, the discharge end 110 of main conveyor 106 would follow an arc about pivot point 118 and move laterally away from the stack as the discharge end 108 of the main conveyor 106 was raised. This would likely interfere with the efficient formation of a stack of material. Therefore, the intake end 108 of the main conveyor 106 is supported by pivot arm 126 which pivots relative to base 116 and the main conveyor 106. This allows the discharge end 110 of the main conveyor 106 to move generally vertically instead of following an arc and causes the intake end 108 of the main conveyor 106 to move laterally toward the stack as the discharge end 110 rises of main conveyor 106 rises.

While this movement of the intake end 108 of the main conveyor 106 helps ensure proper stack formation, it also pulls the transfer conveyor away from the layboy section 102 and creates a gap between intake end 112 of transfer conveyor 104 and layboy section 102. This problem has previously been addressed by providing slats 128 (illustrated in FIG. 3) extending from the discharge end of the layboy section 102 toward transfer conveyor 104. As the intake end 108 of the main conveyor 106 moves away from the layboy section 102, it moves the transfer conveyor 104 away from the layboy section 102 as well. However, the slats 128 span the gap between the layboy 102 and the transfer conveyor and prevent a gap from opening up as the transfer conveyor moves. This, in turn, helps ensure that product and/or scrap material exiting the layboy section 102 will reach transfer conveyor 104 and not accumulate on the ground beneath the stacking machine.

The slats 128 partially address the problem discussed above. However, they are relatively narrow, and small products and/or scrap material still occasionally catches on the slats. It would therefore be desirable to provide a stacking apparatus that allows for improved transfer of material from a layboy section to a transfer conveyor when a main conveyor moves between raised and lowered positions.

SUMMARY OF THE INVENTION

These and other problems are addressed by the present invention, a first aspect of which is a sheet stacking apparatus that includes a conveyor support and an arm pivotably mounted on the conveyor support that is pivotable between a first position and a second position. The stacking apparatus also includes a main conveyor having an intake end and a discharge end, and the main conveyor intake end is pivotably connected to the arm. The apparatus further includes a transfer conveyor with an intake end having an intake end roller and a discharge end with a discharge end roller, where the transfer conveyor discharge end roller is connected to the arm and is movable therewith. A transfer conveyor intake end roller support holds the transfer conveyor intake end roller in a fixed relationship with respect to the conveyor support. The apparatus also includes at least one idler roller, and at least one belt is supported by the intake end roller and discharge end roller and the at least one idler roller. When the arm moves from the first position to the second position, a distance between the transfer conveyor intake end roller and the transfer conveyor discharge end roller increases.

Another aspect of the invention comprises a sheet stacking apparatus that includes a conveyor support and a main conveyor connected to the conveyor support, the main conveyor having an intake end with an intake end roller and a discharge end with a discharge end roller. The main conveyor discharge end is movable between a lowered position and a raised position. The apparatus also includes a transfer conveyor having an intake end roller support holding the intake end roller in a fixed relationship with respect to the conveyor support and a discharge end roller connected to the main conveyor intake end roller. The apparatus includes at least one idler roller, and at least one belt is supported by the transfer conveyor intake end roller and the transfer conveyor discharge end roller and the at least one idler roller. The main conveyor discharge end is movable between a lowered position and a raised position, and the transfer conveyor discharge end roller is shifted away from the transfer conveyor intake end roller by the main conveyor discharge end moving from the lowered position to the raised position.

A further aspect of the invention comprises a method practiced in a sheet stacking apparatus that includes a layboy and a main conveyor supported by a conveyor support, where the main conveyor includes an intake end and a discharge end, and where the main conveyor discharge end is movable between a raised and a lowered position relative to the intake end. The main conveyor intake end moves laterally away from the layboy when the main conveyor discharge end moves from the lowered to the raised position. The method is a method of transferring sheets of material from the layboy to the main conveyor that includes providing a transfer conveyor having an intake end, a discharge end and at least one belt, between the layboy and the main conveyor with the transfer conveyor intake end adjacent the layboy and the transfer conveyor discharge end adjacent the main conveyor, fixing the intake end of the transfer conveyor relative to the layboy, and connecting the discharge end of the transfer conveyor to the intake end of the main conveyor. The method also includes providing first and second idler rollers for adjusting the path of the belt(s), and with the discharge end of the main conveyor in the lowered position, moving the transfer conveyor belt(s) to carry sheets of material from the layboy to the main conveyor. The method also includes moving the main conveyor discharge end from the lowered position toward the raised position and moving the first idler roller in a first direction relative to the layboy while continuing to move the transfer conveyor belt(s) to carry sheets of material from the layboy to the main conveyor.

BRIEF DESCRIPTION OF THE DRAWINGS

These and other aspects and features of embodiments of the invention will be better understood after a reading of the following detailed description together with the attached drawings, wherein.

DETAILED DESCRIPTION

Figure 4:
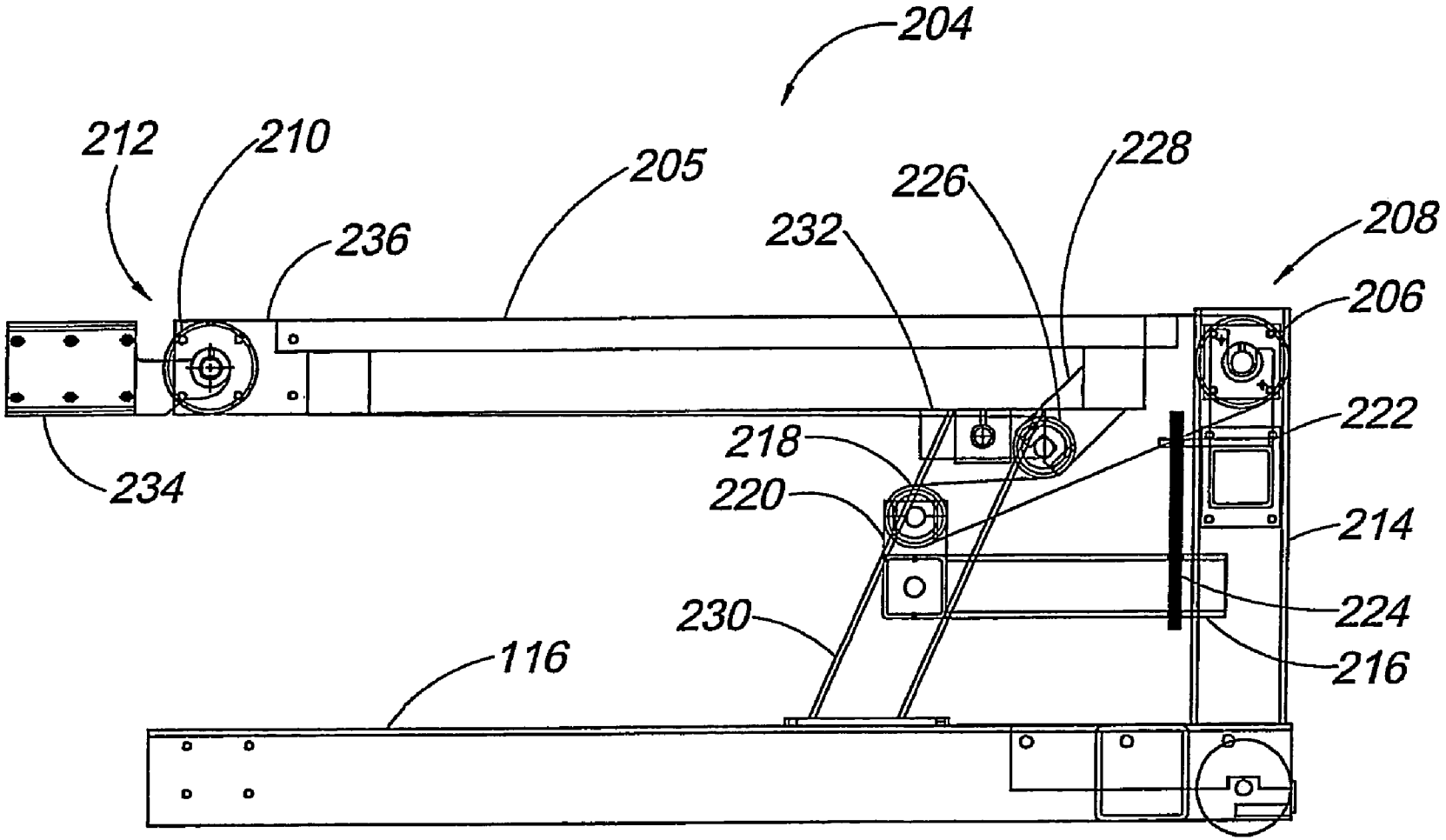
FIG. 4 is side elevational view of a transfer conveyor according to an embodiment of the present invention in a first configuration.
Figure 5:
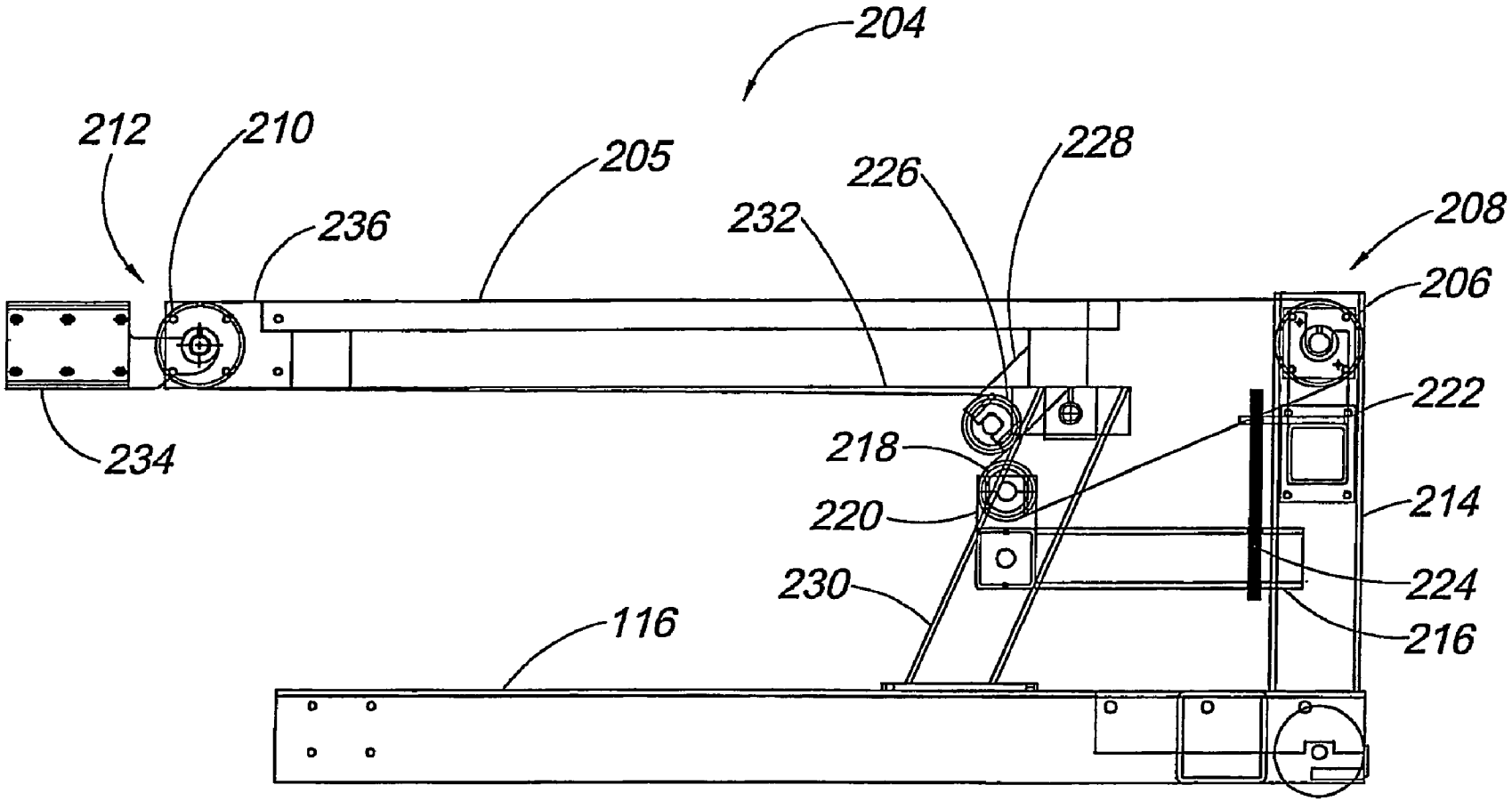
FIG. 5 is a side elevational view of the transfer conveyor of FIG. 4 in a second configuration.
Figure 6:
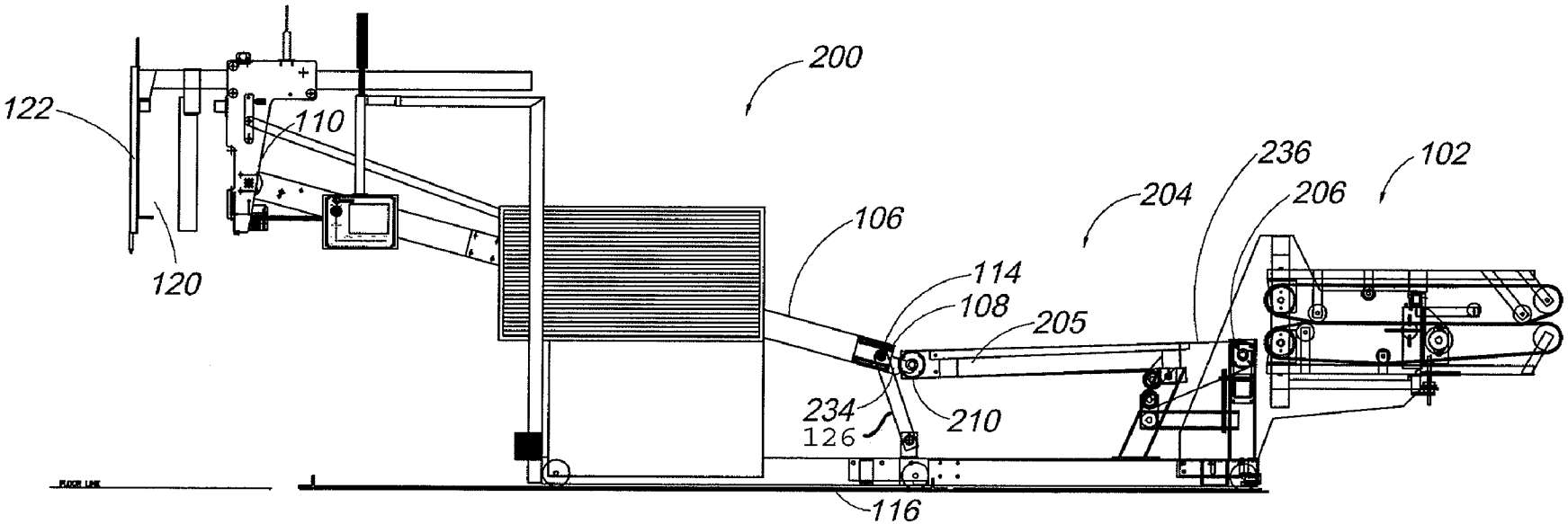
FIG. 6 is side elevational view of a sheet stacking apparatus according to an embodiment of the present invention having a transfer conveyor in the second configuration of FIG. 5.
Figure 7:
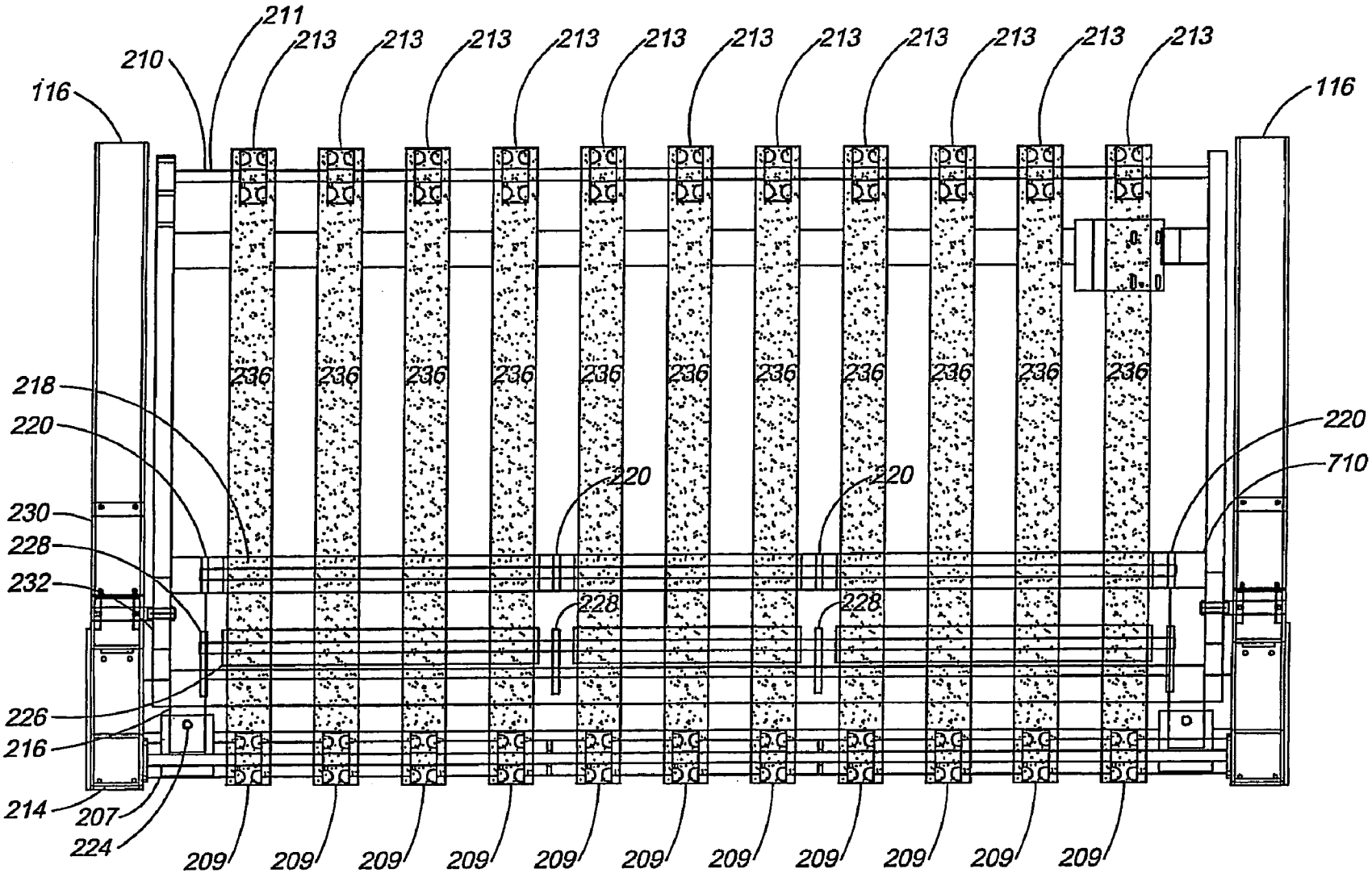
FIG. 7 is a top plan view of the transfer conveyor of FIG. 4.
Figure 8:
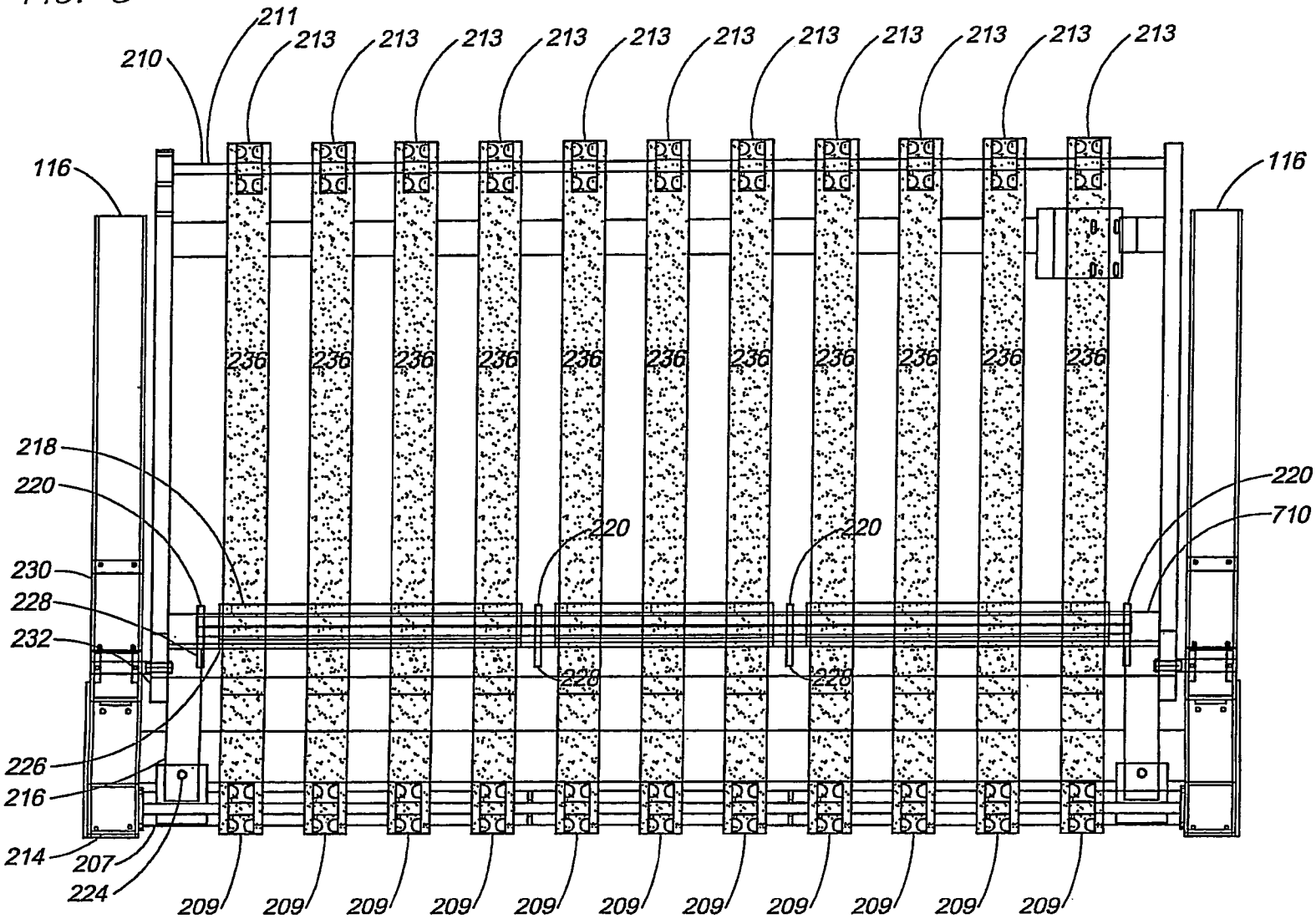
FIG. 8 is top plan view of the transfer conveyor of FIG. 5.

Referring now to the drawings, wherein the showings are for the purpose of illustrating presently preferred embodiments of the invention only and not for the purpose of limiting same, FIG. 6 illustrates a sheet stacking system 200 that includes a conventional layboy 102, a conventional main conveyor 106 and a transfer conveyor 204 according to an embodiment of the present invention. An end of transfer conveyor 204 and an end of main conveyor 106 are supported by a pivot arm 126. With reference to FIGS. 4 and 5, transfer conveyor 204 includes a deck 205 having an intake roller 206 at an intake end 108 that is adjacent layboy 102 and a discharge roller 210 at a discharge end 212 that is adjacent the intake end 108 of main conveyor 106. As illustrated in FIGS. 7 and 8, the intake roller may comprise, for example, a shaft 207 on which a plurality of pulleys 209 are mounted, while the discharge roller 210 may comprise a shaft 211 on which a plurality of pulleys 213 are mounted. A pair of intake roller supports 214 (only one of which is illustrated in FIGS. 4 and 5) supports intake roller 206 in a fixed orientation relative to conveyor support 116 and also includes an idler support arm 216 on which a first idler roller 218 is mounted via a first idler roller bracket 220. Intake roller supports 214 also include a screw bracket 222 connected to idler support arm 216 by a screw 224. A second idler roller 226 is mounted to deck 205 by a second idler roller support bracket 228. Screw 224 is used in an initial set-up of transfer conveyor 204 to set the distance between first idler roller 218 and second idler roller 226 but is fixed during the operation of the system.

Transfer conveyor 204 also includes a bearing support 230 having a centerline angled relative to conveyor support 116, and bearing support 230 supports a bearing 232 on which deck 205 slides. Bearing 232 may be made from a wear-resistance, low friction material such as DuPont's Delrin. A bracket 234 connects transfer conveyor discharge roller 210 to the intake end 108 of main conveyor 106. A plurality of continuous belts 236, only one of which is visible in FIG. 4, extend from transfer conveyor intake roller 206 to discharge roller 210 and from there around second idler roller 226 and first idler roller 218 back to transfer conveyor intake roller 206. One of intake roller 206 or discharge roller 210 is driven by a conventional drive mechanism (not illustrated) to move belts 236 and carry objects supported thereon in a direction from layboy 102 toward main conveyor 106.

Figure 1:
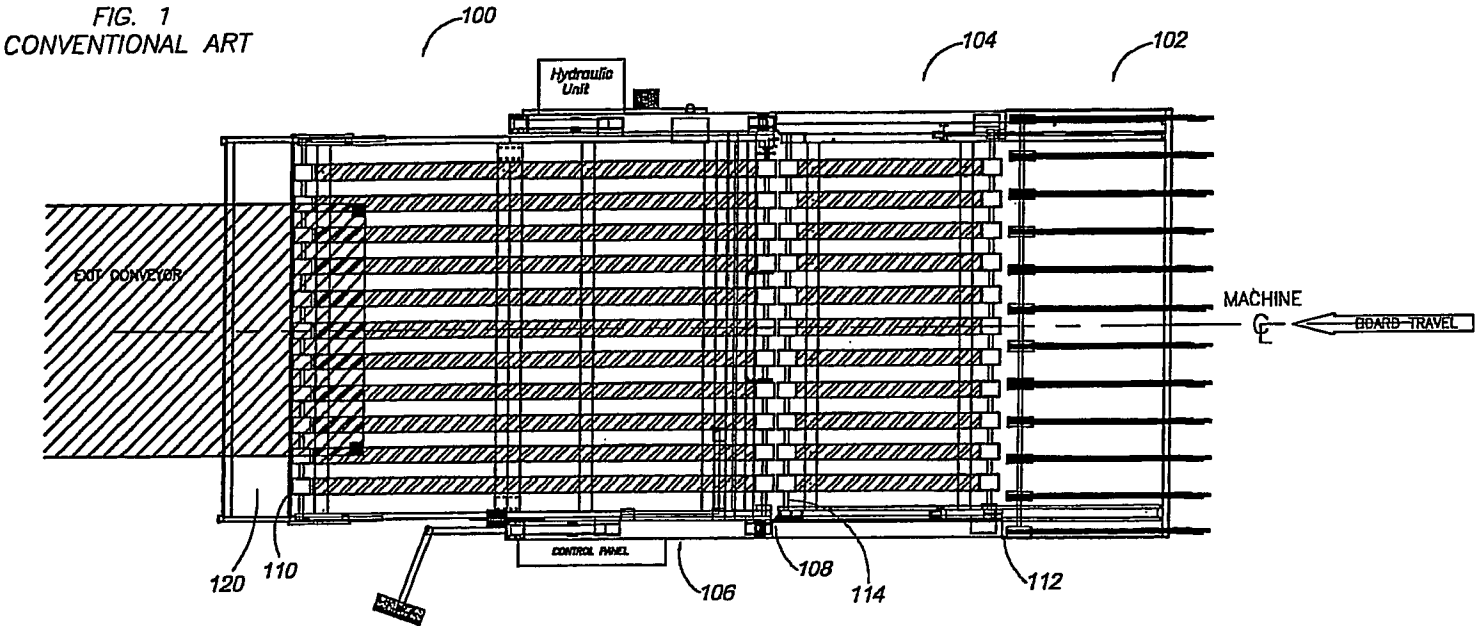
FIG. 1 CONVENTIONAL ART
FIG. 1 is a top plan view of a conventional sheet stacking apparatus including a layboy, a transfer conveyor and a main conveyor.
Figure 2:
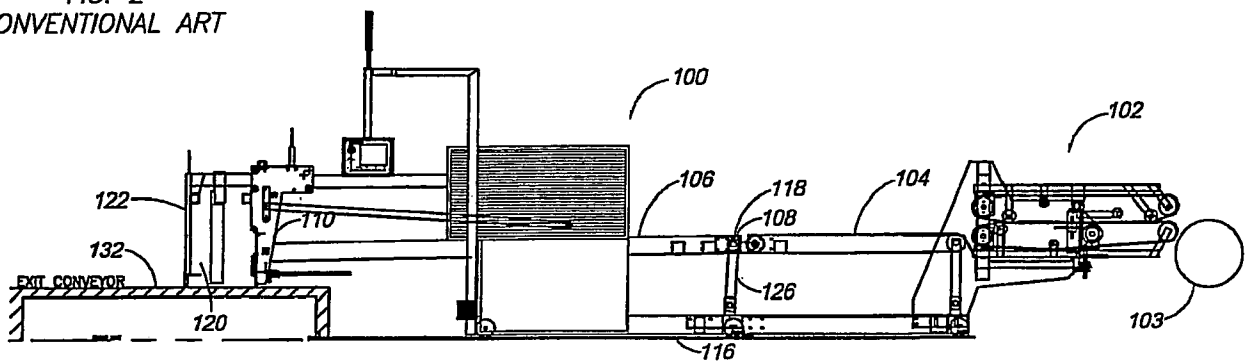
FIG. 2 CONVENTIONAL ART
FIG. 2 is a side elevational view of the sheet stacking apparatus of FIG. 1 in a lowered position.
Figure 3:
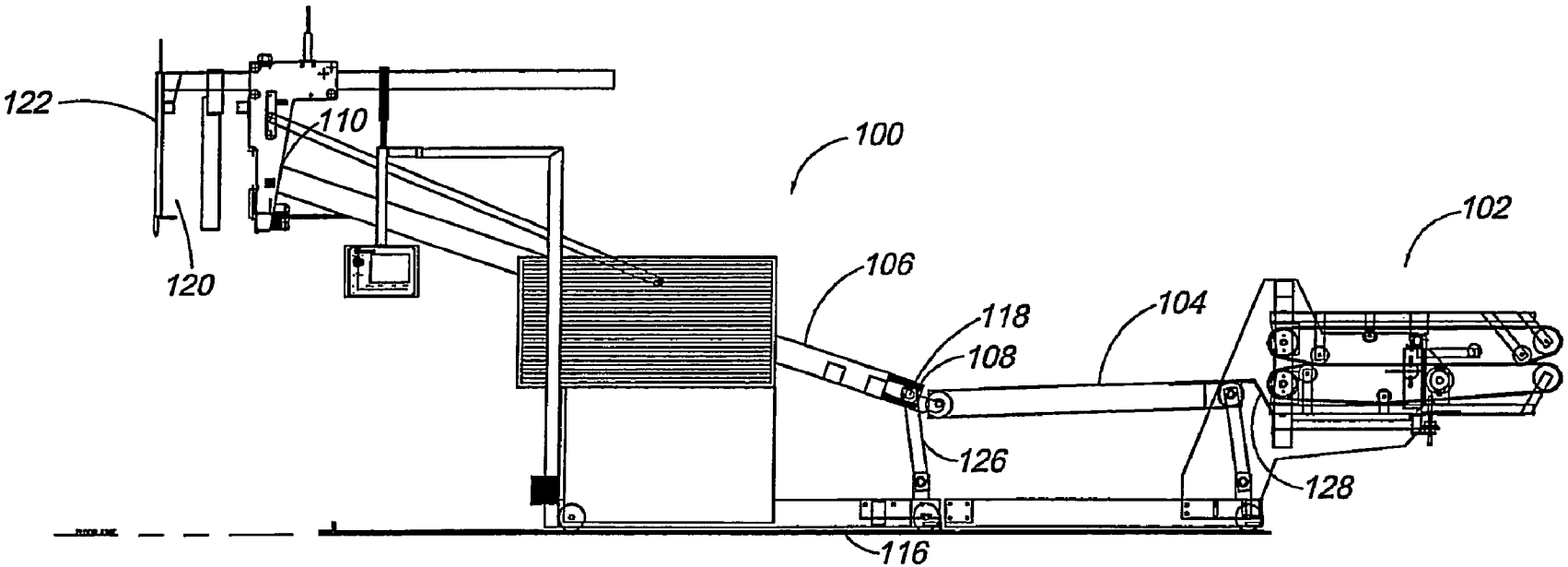
FIG. 3 CONVENTIONAL ART
FIG. 3 is a side elevational view of the sheet stacking apparatus of FIG. 1 in a raised position.

In operation, the main conveyor 106 starts in a lowered position, and in this position, transfer conveyor 204 is configured as illustrated in FIG. 4 with a relatively small separation between deck 205 and intake roller 206. As main conveyor 106 is raised during the stack formation process, intake end 108 of the main conveyor 106 begins to move away from layboy 102. Because main conveyor intake end 108 is connected to transfer conveyor discharge roller 210 by bracket 234, the raising of discharge end 110 of main conveyor 106 pulls the transfer conveyor discharge roller 210 away from transfer conveyor intake roller 206 and causes deck 205 to slide on bearing 232. This in turn moves second idler roller 226 toward first idler roller 218 and decreases the length of belts 236 beneath deck 205. This increases the length of belts 236 above deck 205 in order to provide a transfer conveyor surface for transferring sheets of material that increases in length with the increasing gap between layboy 102 and main conveyor 106. This motion continues until the position illustrated in FIG. 6 is reached. This process reverses when main conveyor 106 is returned to the lowered position illustrated in FIG. 2. Tension in belts 236 is adjusted using screw 224.

The present invention has been described herein in terms of a preferred embodiment. However, variations and additions to this embodiment will become apparent to those of ordinary skill in the art upon a reading of the foregoing description. It is intended that all such additions and variations comprise a part of the present invention to the extent they fall within the scope of the several claims appended hereto.

We claim:

1. A sheet stacking apparatus comprising:

a conveyor support;

an arm pivotably mounted on the conveyor support and pivotable between a first position and a second position;

a main conveyor having an intake end and a discharge end, the main conveyor intake end being pivotably connected to said arm;

a transfer conveyor having an intake end having an intake end roller and a discharge end having a discharge end roller, the discharge end roller being connected to said arm and being movable therewith;

a transfer conveyor intake end roller support holding the transfer conveyor intake end roller in a fixed relationship with respect to the conveyor support;

at least one idler roller; and at least one belt supported by said intake end roller and discharge end roller and said at least one idler roller;

whereby, when said arm moves from said first position to said second position a distance between said transfer conveyor intake end roller and said transfer conveyor discharge end roller increases.

2. The sheet stacking apparatus of claim 1 wherein said transfer conveyor includes a deck and wherein said stacking apparatus includes a deck support having a bearing surface for slidably supporting at least a portion of said deck.

3. The sheet stacking apparatus of claim 2 wherein said at least one idler roller comprises a first idler roller mounted to said deck to be movable with said deck and a second idler roller mounted in a fixed relationship relative to said conveyor support.

4. The sheet stacking apparatus of claim 3 wherein said bearing surface comprises a smooth wear resistant material.

5. The sheet stacking apparatus of claim 2 wherein said deck support has a centerline meeting the conveyor support at an acute angle.

6. The sheet stacking apparatus of claim 3 wherein said transfer conveyor intake end roller support includes an idler support arm projecting away from the transfer conveyor intake end, the second idler roller being mounted on said idler support arm.

7. The sheet stacking apparatus of claim 6 wherein said idler support arm is movable relative to said conveyor support to adjust a distance between said first and second idler rollers.

8. The sheet stacking apparatus of claim 1 wherein said main conveyor discharge end is movable between a lowered position and a raised position and wherein said transfer conveyor discharge end roller is shifted away from said transfer conveyor intake end roller by said main conveyor discharge end moving from said lowered position to said raised position.

9. The sheet stacking apparatus of claim 1 wherein said main conveyor discharge end is movable between a lowered position and a raised position, and wherein moving said main conveyor discharge end from the lowered position to the raised position moves said conveyor deck relative to said bearing surface and moves said first idler roller relative to said second idler roller.

10. The sheet stacking apparatus of claim 1 including a layboy section connected to the conveyor support on a side of the transfer conveyor opposite from the main conveyor and arranged to feed sheets of material onto the transfer conveyor.

11. A sheet stacking apparatus comprising:

a conveyor support;

a main conveyor connected to said conveyor support and having an intake end having an intake end roller and a discharge end having a discharge end roller, said main conveyor discharge end being movable between a lowered position and a raised position;

a transfer conveyor having a intake end roller support holding the intake end roller in a fixed relationship with respect to the conveyor support and a discharge end roller connected to the main conveyor intake end roller;

at least one idler roller; and at least one belt supported by said transfer conveyor intake end roller and said transfer conveyor discharge end roller and passing over said at least one idler roller;

said main conveyor discharge end being movable between a lowered position and a raised position, and wherein said transfer conveyor discharge end roller is shifted away from said transfer conveyor intake end roller by said main conveyor discharge end moving from said lowered position to said raised position.

12. The sheet stacking apparatus of claim 11 wherein said transfer conveyor includes a deck and including a deck support having a bearing surface for slidably supporting at least a portion of said deck.

13. The sheet stacking apparatus of claim 12 wherein said at least one idler roller comprises a first idler roller mounted to said deck to be movable with said deck and a second idler roller mounted in a fixed relationship relative to said conveyor support.

14. The sheet stacking apparatus of claim 13 including an idler support arm projecting away from the transfer conveyor intake end roller support, the second idler roller being mounted on said idler support arm.

15. The sheet stacking apparatus of claim 14 wherein said idler support arm is movable relative to said conveyor support to adjust a distance between said first and second idler rollers.

16. The sheet stacking apparatus of claim 11 including a layboy section connected to the conveyor support on a side of the transfer conveyor opposite from the main conveyor and arranged to feed sheets of material onto the transfer conveyor.

17. In a sheet stacking apparatus including a layboy and a main conveyor supported by a conveyor support, the main conveyor including an intake end and a discharge end, the main conveyor discharge end being movable between a raised and a lowered position relative to the intake end, the main conveyor intake end being moved laterally away from the layboy when the main conveyor discharge end moves from the lowered to the raised position, a method of transferring sheets of material from the layboy to the main conveyor comprising the steps of:

providing a transfer conveyor, having an intake end, a discharge end and at least one belt, between the layboy and the main conveyor with the transfer conveyor intake end adjacent the layboy and the transfer conveyor discharge end adjacent the main conveyor;

fixing the intake end of the transfer conveyor relative to the layboy;

connecting the discharge end of the transfer conveyor to the intake end of the main conveyor;

providing first and second idler rollers for adjusting the path of the at least one belt;

with the discharge end of the main conveyor in the lowered position, moving the transfer conveyor at least one belt to carry sheets of material from the layboy to the main conveyor; and moving the main conveyor discharge end from the lowered position toward the raised position and moving the first idler roller in a first direction relative to the layboy while continuing to move the transfer conveyor at least one belt to carry sheets of material from the layboy to the main conveyor.

18. The method of claim 17 wherein moving the first idler roller in a first direction comprises moving the first idler roller away from the layboy.

19. The method of claim 17 including the additional step of moving the discharge end of the main conveyor toward the lowered position and moving the first idler roller in a second direction opposite to the first direction.

* * * * *